United States Patent [19]

Greenwood et al.

[11] Patent Number: 4,991,848

[45] Date of Patent: Feb. 12, 1991

[54] GAMING MACHINE WITH A PLATEAUED PAY SCHEDULE

[75] Inventors: Nick E. Greenwood, Reno, Nev.; Dominic Tiberio, Addison, Ill.

[73] Assignee: Bally Manufacturing Corporation, Chicago, Ill.

[21] Appl. No.: 390,026

[22] Filed: Aug. 7, 1989

[51] Int. Cl.[5] ..... A63F 5/04

[52] U.S. Cl. ..... 273/143 R; 273/138 A

[58] Field of Search ..... 273/138 A, 143 R; 364/410, 412, 417, 411

[56] References Cited

U.S. PATENT DOCUMENTS

| | | | |
|---|---|---|---|
| 4,373,723 | 2/1983 | Brown et al. | 273/138 A |
| 4,448,419 | 5/1984 | Telnaes | 273/138 A |
| 4,573,681 | 3/1986 | Okada | 273/143 R |
| 4,679,143 | 7/1987 | Hagiwara | 273/138 A |
| 4,711,451 | 12/1987 | Pajak et al. | 273/138 A |
| 4,756,531 | 6/1988 | DiRe et al. | 273/138 A |
| 4,838,552 | 6/1989 | Hagiwara | 273/138 A |
| 4,858,932 | 8/1989 | Keane | 273/138 A |

*Primary Examiner*—Edward M. Coven
*Assistant Examiner*—Jessica J. Harrison
*Attorney, Agent, or Firm*—Jenner & Block

[57] ABSTRACT

Convenience and speed of play in a gaming machine are enhanced by providing a payout schedule that includes one very large payout along with a number of other large payout values that are plateaued just below an administrative value.

22 Claims, 4 Drawing Sheets

PAY SCHEDULE

| WINNING SYMBOL COMBINATIONS | 1 COIN PAY VALUE | 2 COIN PAY VALUE | PULLS PER HIT |
|---|---|---|---|
| 3 BLACK GOLDS | $5,000 | $25,000 | 262144 |
| 3 TRIPLE BARS | $600 | $1,195 | 4096 |
| 2 BG & 1 TB | $575 | $1,150 | 21845 |
| 1 BG & 2 TB | $560 | $1,120 | 5461 |
| 3 DOUBLE BARS | $500 | $1,000 | 512 |
| 2 BG & DB | $275 | $550 | 10923 |
| 1 BG & 2DB | $260 | $520 | 1365 |
| 3 SINGLE BARS | $100 | $200 | 84 |
| 2 DB & SB | $75 | $150 | 5958 |
| 1 BG & 2 SB | $60 | $120 | 407 |
| 1 BG & 2 MB | $35 | $70 | 210 |
| 3 MIXED BARS | $25 | $50 | 17 |
| 2 BLACK GOLDS | $25 | $50 | 2405 |
| 1 BLACK GOLD | $10 | $20 | 27 |

PAY SCHEDULE 46 48 50 42 44

| WINNING SYMBOL COMBINATIONS | 1 COIN PAY VALUE | 2 COIN PAY VALUE | PULLS PER HIT |
|---|---|---|---|
| 2 DO + 1 SE | $12,000 | $25,000 | 262144 |
| 1 DO + 2 SE | $5,995 | $12,500 | 131072 |
| 3 SEVENS | $3,000 | $5,995 | 262144 |
| 2 DO + 1 TB | $1,600 | $3,200 | 43691 |
| 1 DO + 2TB | $800 | $1,600 | 3972 |
| 2 DO + 1 DB | $800 | $1,600 | 29127 |
| 3 TRIPLE BARS | $400 | $800 | 1456 |
| 1 DO + 2 DB | $400 | $800 | 1442 |
| 2 DO + 1 SB | $200 | $400 | 16384 |
| 3 DOUBLE BARS | $200 | $400 | 520 |
| 2 DO + 1 BL | $180 | $360 | 8192 |
| 1 DO + 2 SB | $100 | $200 | 482 |
| 1 DO + 2 AB | $50 | $100 | 235 |
| 3 SINGLE BARS | $50 | $100 | 57 |
| 3 ANY BARS | $25 | $50 | 12 |
| 1 DO + 2BL | $15 | $30 | 128 |

FIG. 4

PAY SCHEDULE 56 58 60 52 54

| WINNING SYMBOL COMBINATIONS | 1 COIN PAY VALUE | 2 COIN PAY VALUE | PULLS PER HIT |
|---|---|---|---|
| 3 BLACK GOLDS | $5,000 | $25,000 | 262144 |
| 3 TRIPLE BARS | $600 | $1,195 | 4096 |
| 2 BG & 1 TB | $575 | $1,150 | 21845 |
| 1 BG & 2 TB | $560 | $1,120 | 5461 |
| 3 DOUBLE BARS | $500 | $1,000 | 512 |
| 2 BG & DB | $275 | $550 | 10923 |
| 1 BG & 2DB | $260 | $520 | 1365 |
| 3 SINGLE BARS | $100 | $200 | 84 |
| 2 DB & SB | $75 | $150 | 5958 |
| 1 BG & 2 SB | $60 | $120 | 407 |
| 1 BG & 2 MB | $35 | $70 | 210 |
| 3 MIXED BARS | $25 | $50 | 17 |
| 2 BLACK GOLDS | $25 | $50 | 2405 |
| 1 BLACK GOLD | $10 | $20 | 27 |

FIG. 5

PAY SCHEDULE 66 68 70 52

| WINNING SYMBOL COMBINATIONS | 1 COIN PAY VALUE | 2 COIN PAY VALUE | PULLS PER HIT |
|---|---|---|---|
| 3 BLACK GOLDS | $5,000 | $25,000 | 262144 |
| 3 TRIPLE BARS | $575 | $1,145 | 3495 |
| 2 BG & 1 TB | $600 | $1,195 | 20165 |
| 1 BG & 2 TB | $585 | $1,165 | 4766 |
| 3 DOUBLE BARS | $500 | $1,000 | 1049 |
| 2 BG & DB | $525 | $1,050 | 13107 |
| 1 BG & 2DB | $510 | $1,020 | 2097 |
| 3 SINGLE BARS | $100 | $200 | 68 |
| 2 DB & SB | $125 | $250 | 5578 |
| 1 BG & 2 SB | $110 | $220 | 356 |
| 1 BG & 2 MB | $35 | $70 | 216 |
| 3 MIXED BARS | $25 | $50 | 18 |
| 2 BLACK GOLDS | $25 | $50 | 2405 |
| 1 BLACK GOLD | $10 | $20 | 27 |

GAMING MACHINE WITH A PLATEAUED PAY SCHEDULE

TECHNICAL FIELD

The invention relates to the field of coin operated gaming machines and more particularly to gaming machines that can provide a very high payout relative to the value of a coin input.

BACKGROUND OF THE INVENTION

Recent advances in gaming machine technology and in particular with respect to microprocessor controlled slot or reel type machines have made it possible to offer a machine having a very high maximum payout. For example, the advent of the virtual reel concept as disclosed in U.S. Pat. Nos. 4,448,419 and 4,711,451, along with the non-uniform probability technique described in U.S. Pat. No. 4,858,932, issued 8/22/89, have resulted in slot machines where the maximum payout can be a thousand times, five thousand times, or even a greater multiple of the coin input. In practice, these machines have been provided with a graduated pay schedule where there is a maximum payout, such as $25,000 for a two five dollar coin input, and a graduated series of payouts such as $12,000, $6,000, $3,200 and $1,600 along with a number of lesser payouts for the two coin input.

These types of high payout machines have become very popular with players to a large extent due to the possibility of receiving a very large payoff for a relatively small investment. However, it has been observed that these payout schedules have a disadvantage in that for payouts that exceed a certain administrative value, various organizations, including government, licensing and tax authorities as well as internal casino accounting procedures, require that certain administrative actions be taken including the filling out of forms by the players in order to properly account for these payouts. Because these newer machines often have a number of payouts that are above the administrative value, casino operating expenses are increased due to the number of additional personnel required to perform these functions. Also, the players are inconvenienced and game play is significantly slowed which can affect casino income.

SUMMARY OF THE INVENTION

It is, therefore, an object of the invention to provide a gaming machine with a plateaued pay schedule having one very large payout and a number of other payouts which are just below an administrative value. The pay schedule can also include a number of other lesser payouts well below the administrative value.

It is an additional object of the invention to provide a gaming apparatus having a processor for randomly selecting and displaying indicia along with generating a pay signal in response to the selected indicia according to a pay schedule contained in the processor memory where the pay schedule includes a maximum payout or win corresponding to one combination of indicia, a first group of payouts that are just below an administrative value for other winning combinations of indicia and a second group of payouts are substantially below the administrative value. In some cases the first group can have six or more payouts and the maximum payout can be over 1000 times the value of the coin input or 20 times greater than the administrative value.

It is a further object of the invention to provide a reel type slot machine that includes a processor for rotating and randomly stopping the reels in response to a coin input, a pay schedule stored in memory that governs the amount of payout for various combinations of symbols on the reels where the pay schedule includes: a maximum payout of over 1000 times the coin input; a first group of at least four payouts that are within 80% of an administrative value; and a second group of payouts that have values substantially less than the first group. The slot machine can also include a second payout schedule in memory which responds to a coin input of a lesser value where this pay schedule has a reduced maximum payout and where the remaining payouts are less than one-half of the administrative value.

BRIEF DESCRIPTION OF THE DRAWINGS

FIG. 4 is a chart representing a pay schedule according to a first embodiment of the invention;

FIG. 5 is a chart representing a pay schedule according to a second embodiment of the invention;

DETAILED DESCRIPTION OF THE INVENTION

Figure 1:
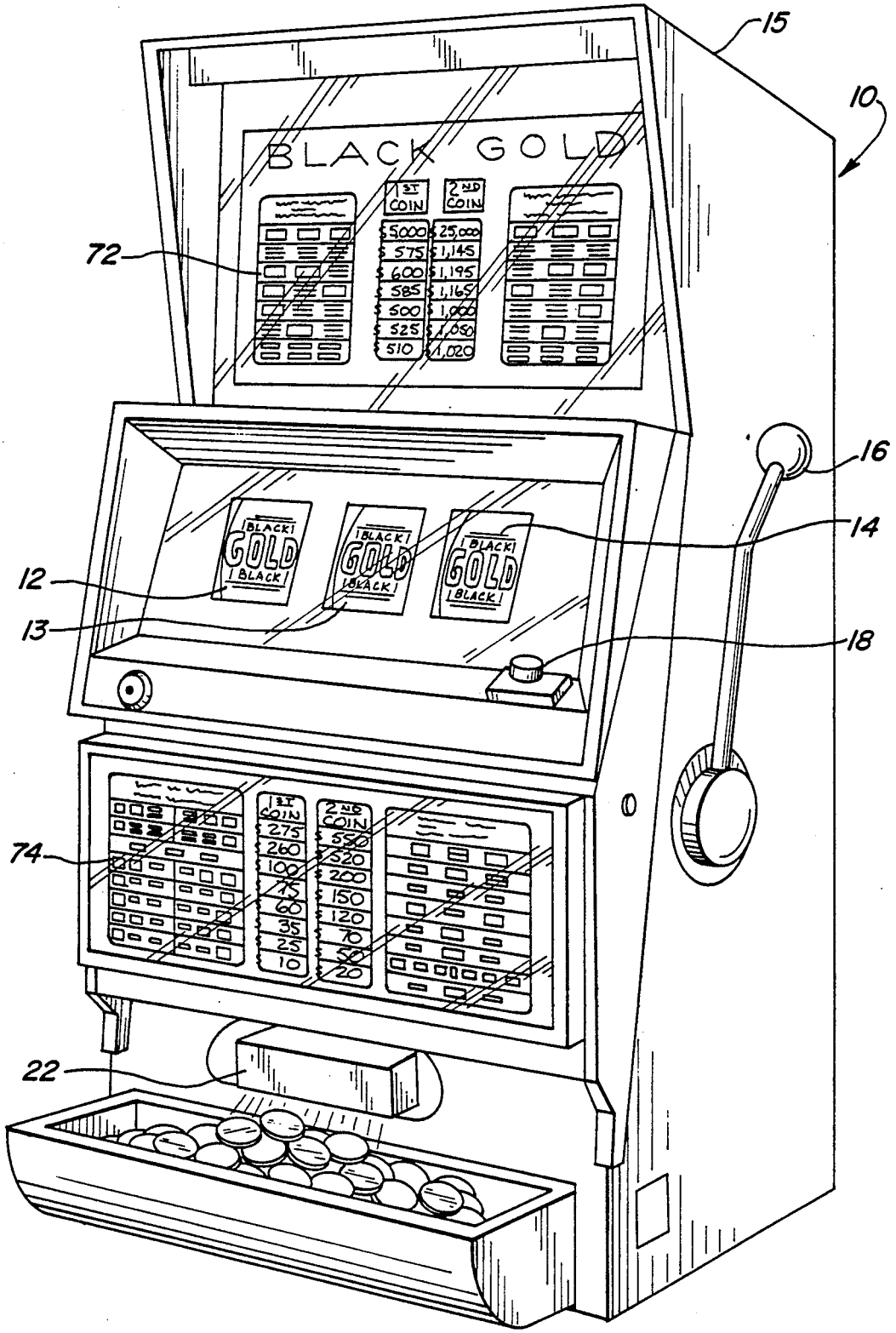
FIG. 1 is a perspective view of a reel-type gaming apparatus embodying the invention.

A representative example of a gaming apparatus 10, in this case a reel type slot machine, employing the invention is shown in FIG. 1. The gaming apparatus 10 includes three symbol bearing reels 12, 13 and 14 within a housing 15 which are caused to rotate in response to a player actuated handle 16 after a coin is inserted into a coin input slot 18.

Figures 2, 3:
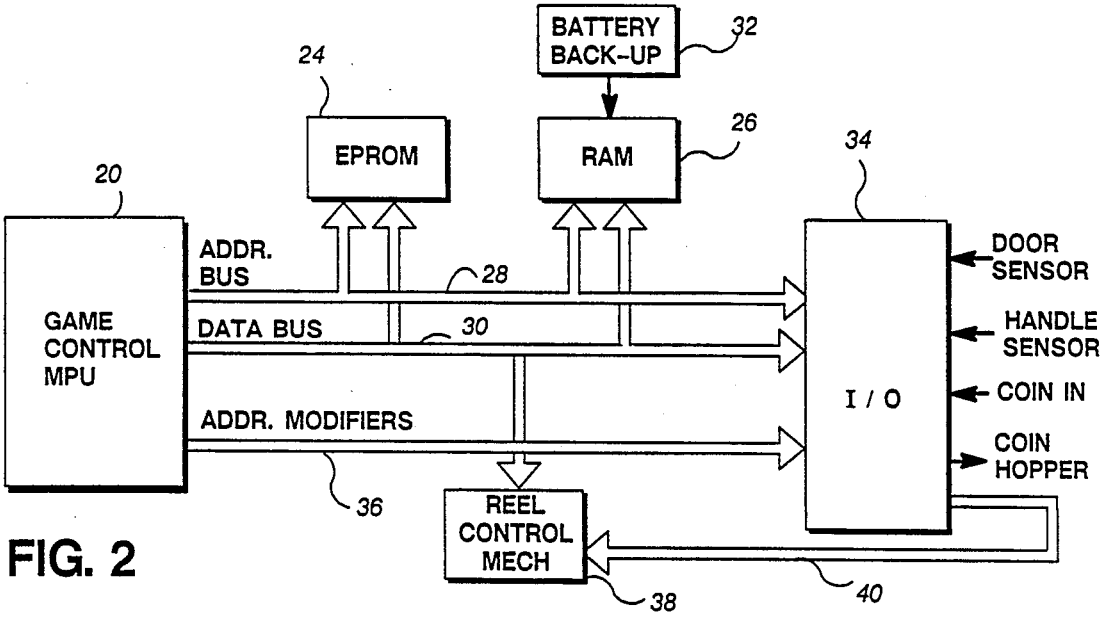
FIG. 2 is a block diagram of the electronic control circuit for the gaming apparatus of FIG. 1.
FIG. 3 is a chart representing a pay schedule of a type previously used in gaming apparatus of FIG. 1.

The gaming apparatus 10 includes a game control microprocessor 20, as shown in FIG. 2, which stops each of the reels 12–14 to display three randomly selected symbols along win lines. If the symbols displayed along the win lines form a winning combination, the microprocessor 20 generates a pay signal which can cause a coin hopper (not shown) to payout, through a payout chute 22 a specified number of coins or tokens, or increment a credit counter or provide a signal to an attendant to provide the payout.

The game control microprocessor 20, shown in FIG. 2, is preferably a Motorola 68000 processor. The processor 20 controls the operation of the gaming apparatus 10 in accordance with programs and data stored in an EPROM 24 and RAM 26. The EPROM 24 and RAM 26 are coupled to the processor 20 by an address bus 28 and a data bus 30. To ensure that no data stored in the RAM 26 is lost during a power failure, the RAM 26 is coupled to a battery backup circuit 32. The game control microprocessor 20 is also coupled to various input sensors and apparatus as well as the coin hopper through an input/output board 34 which is coupled to the processor 20 through the address and data buses 28 and 30 and an address modifier line 36. In order to address the input/out board 34, the game control processor 20 must output the correct address modifiers for the input/output board on line 36 as well as the address for the input/output board 34 on the address bus 28.

The game control microprocessor 20 controls each of the reels 12–14 through a reel control mechanism 38 which is coupled to the data bus 30. The reel control mechanism 38 includes a stepper motor or the like for each of the reels 12–14 to start and stop the rotation of the reels in accordance with the data on bus 40 from the game control microprocessor 20. The reel control mechanism is also coupled to the input/output board 34 which is responsive to the microprocessor 20 for selecting a particular one of the stepper motor controls to receive data from the bus 40.

In the gaming apparatus or slot machine 10 the microprocessor 20 randomly selects stop positions for each of the reels 12, 13 and 14. Once the stop positions have been selected the microprocessor determines whether a win condition is present and, if so, how much the payout should be. In order to accomplish this, a pay schedule is stored in the EPROM 24 which is accessed by the microprocessor 20 after the reel stops have been selected to determine the payout, if any.

An example of a pay schedule 42 of the type conventionally used in slot machines 20 is provided in FIG. 3. In the first column 44 are listed the combinations of symbols on reels 12, 13 and 14 that form winning combinations. A second column 46 specifies the corresponding payout for each winning combination when one $5 coin has been deposited in the slot 18 and a third column 48 specifies the payout when two $5 coins have been deposited. It should be noted that the term "coin" as used in this description of the invention can include tokens, bills accepted by a bill accepter, credits from a credit card or credit play as well as any other method of inputting value into the gaming apparatus 10 in order to initiate game play. A column 50 is included in FIG. 3 so as to provide an indication of the average number of "pulls per hit" i.e., the odds of obtaining the winning combination of column 44 and as such would not normally be included in the memory 24.

During normal machine operation, the microprocessor 20 after selecting the stop positions of the reels 12, 13 and 14 determines which symbols on the reels 12, 13 and 14 are in the pay position, searches column 44 in pay schedule table 42 for a winning combination of symbols and if there is a match generates a pay signal that represents the pay value from either column 46 or column 48 corresponding to the winning combination. The microprocessor 20 responds to the pay signal by causing the coin hopper to pay out through the chute 22 the number of coins equivalent to the corresponding pay value from column 46, credit the player with this pay value or, especially in the cases of larger win values, generate an appropriate display on the machine 20 so that this win value can be paid by an attendant.

Assuming for the purpose of this disclosure that the administrative value is $1,200, it can be seen from columns 46 and 48 that there will be four winning payouts for a one coin input and six for a two coin input which are greater than the administrative value. Thus the pay schedule 42 shown in FIG. 3 will result in a significant administrative burden on the casino personnel as well as the players due to the relatively large number of payouts over the administrative value.

In FIG. 4 is illustrated a pay schedule 52 that overcomes this problem but at the same time provides a substantial player incentive by permitting a maximum win value of $25,000 for a two $5 coin input. In particular the winning symbol combinations are shown in a column 54 with the corresponding coin pay values in a pair of columns 56 and 58. As with FIG. 3, FIG. 4 includes a column 60 to provide an indication of the relative probabilities of the occurrences of the symbol combinations of column 54. As can be seen from column 58 the pay schedule 52 provides a $25,000 maximum payout with the next four highest payouts plateaued just below the administrative value of $1,200. The remaining payouts in column 58 are less than half of the administrative value. As a result by plateauing the payouts 58 in this manner, player incentives are maximized while administrative burdens are minimized.

With respect to the payouts in column 56, there is a maximum payout of $5,000 for a single $5 coin but because the value of the coin input is one-half the value in column 58, all of the remaining values are well below the administrative value. Also in this case the maximum payout in column 56 is only one-fifth of the maximum payout in column 58 to further encourage the players to play two coins instead of one.

Another embodiment of a pay schedule 62 according to the invention is shown in FIG. 5. Again, the winning symbol combinations are listed in a column 64 with the payout values for one and two coin play presented in a pair of columns 66 and 68 respectively and the relative probability of achieving the winning combinations in column 66 illustrated in a column 70. In this case there are six payouts in column 68 that are below but within 83% of the administrative value of $1,200. As is conventional in the gaming industry, the values for the larger payouts in columns 66 and 68 are displayed on a backlighted top glass 72 portion of the machine 10 and the lesser payout values on a belly glass 74 portion of the machine 10.

Another aspect of the invention is to provide most of the six payouts in column 68 that are just below the administrative value in "non-rounded" denominations. That is, the payout values are not in major denominations of currency such as $1,000 but instead include amounts representing minor increments such as $145 and $50 as shown in column 68. This approach has two advantages. First, it makes it possible to provide a number of differentiated payout increments which are closely spaced to the administrative value. Secondly, by providing these small amounts as part of the larger payouts, the player will have a tendency to play these odd or leftover amounts from the larger payout thereby increasing play of the machine 10. When presented with a check or currency for a rounded amount players will often just walk away with their winnings discontinuing play on that machine.

Figure 6:
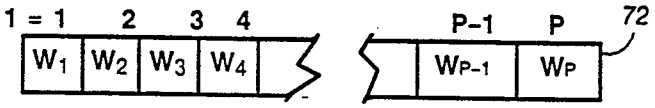
FIG. 6 is an illustration of a probability factor array in the memory of FIG. 2.

In order to facilitate the very high maximum payouts along with plateaued, non-rounded payouts as discussed above, the preferred embodiment of the invention, as implemented in a reel type slot machine 10, utilizes a non-uniform type stop mechanism. In this approach a portion of non-volatile memory either the EPROM 24 or RAM 26 is configured into an array 72 as shown in FIG. 6 for each reel 12–14 in the apparatus 10. Each element of the array 72 contains a probability factor $W_i$ where i denotes a stop index. There will be a value of i corresponding to each programmed stop for the reels 12–14. For example, if a reel has 24 stops, the value of i will range from 1 to 24 where the subscript p denotes the last or maximum number of reel stops. Thus there will be p elements having probability values $W_i$ in each array 72.

Figure 7:
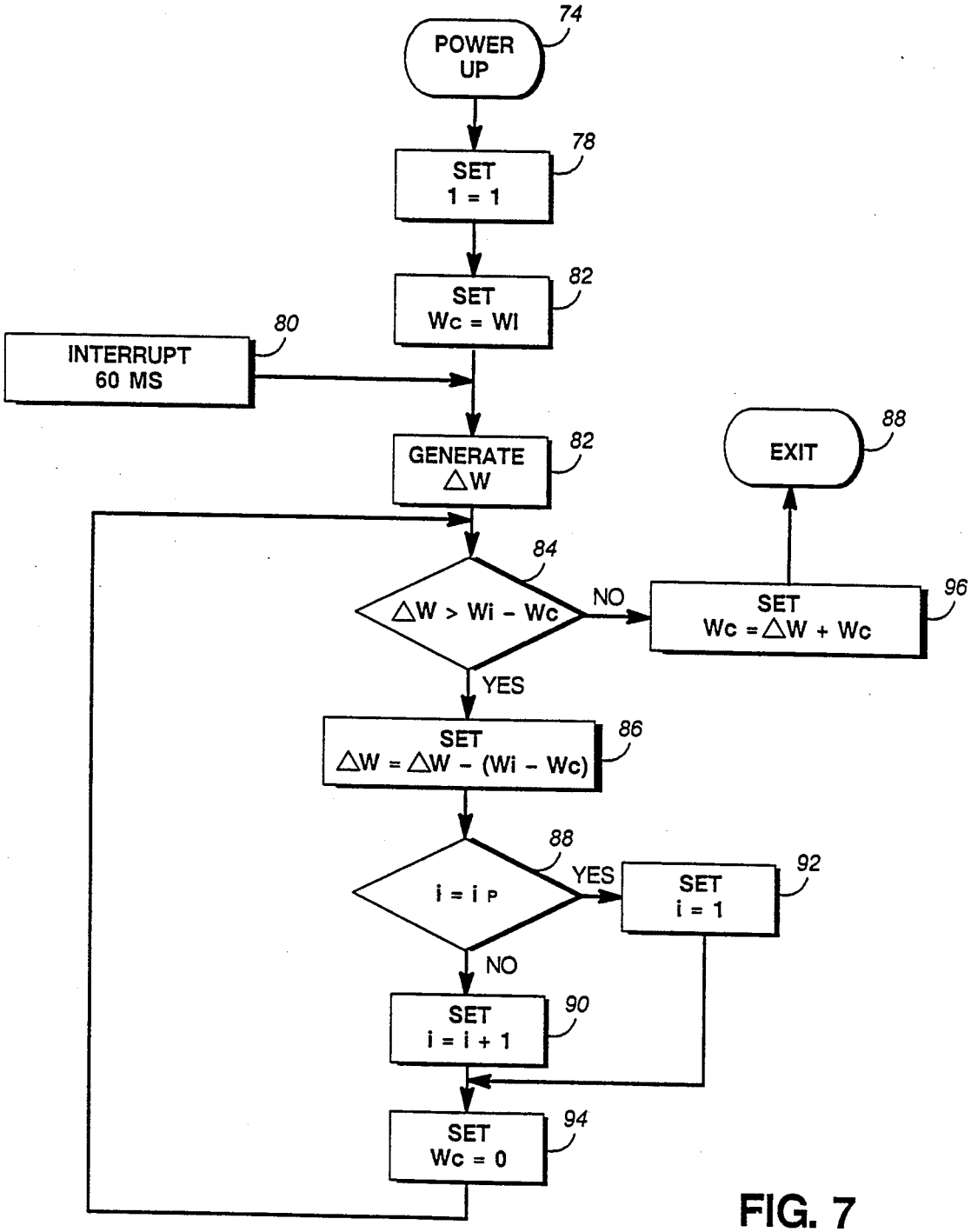
FIG. 7 is a flow chart illustrating control of the reels in the apparatus of FIG. 1 using the array of FIG. 6.

Operation of the non-uniform mechanism is illustrated by the flow chart of FIG. 7. When the apparatus 10 is initially powered up as indicated at 74, the processor 20 will set the value of i equal to 1 as shown at 76. The initialization process also includes at 78 the setting of a residual probability value $W_c$ to the value of $W_i$.

The actual random selection of the reel stop represented by the stop index i beings with a processor 20 initiated interrupt 80. In the preferred embodiment of the invention the interrupt 80 is initiated at regular intervals, preferably every 60 ms. The first step in the procedure after the interrupt 80 is to randomly select at 82 a probability value represented by $\Delta W$. The preferred parameters for $\Delta W$ will be discussed below.

At this point a recursive routine is entered beginning with a comparison at 84 of the value of $\Delta W$ to $W_i$ less $W_c$. In the event $\Delta W$ is larger than this quantity, the value of $W_i$ minus $W_c$ is subtracted from $\Delta W$ at 86. If the value of i is less than the maximum stop index $i_p$ as determined at 88, the value of i is incermental by 1 at 90. On the other hand, if $i=i_p$ then i is reset to 1 at 92. The next step 94 is to set the value of the residual probability $W_c$ to zero and to return to the comparison step at 84.

This routine continues until the value of $\Delta W$ is equal or less than $W_i-W_c$, whereupon the value of $W_c$ is equal to $\Delta W+Wc$ at 96 and the routine initiated by the interrupt 80 is exited as indicated at 98.

The procedures as illustrated in FIG. 7 will be executed at 60 ms for each reel 12–14 on a continuous basis as long as the apparatus 10 is in operation. The time required to cycle through all the stop indexes $i=o$ to $i_p$ is proportional on the average to the sum of the values of $W_i$ in 72. At a predetermined time after a player initiated an event such as a pull on the handle 16 of FIG. 1, the current value of the stop index i is identified and it is used to stop the reel 12, 13 or 14 at the predetermined position corresponding to that index value. Over an extended period the amount of time that i remains at a particular value will on the average be proportional to the relative corresponding value of the probability factor $W_i$. For example, if $W_5$ equals 2 and $W_6$ equals 1 then on the average i will equal 5 twice as often as it will equal 6. Thus by selecting the appropriate relative values of $W_i$ in FIG. 6 the relative stopping frequencies of the reel stops can be predetermined. In the context of a continuously operating apparatus 10 and in particular with the routine of FIG. 7 running on a continuous basis, the handle pull can be considered a random event. Therefore, the value of i and hence the reel stop position will be selected randomly with the value of i proportional in frequency to the values of $W_i$.

A further randomizing factor is provided by randomly generating the probability value $\Delta W$ as shown at 82 in FIG. 7. Also in this embodiment of the invention the range of randomly generated values of $\Delta W$ can affect the operation of the apparatus 10. If, for example, the permitted maximum value of $\Delta W$ is too high, it can introduce a bias factor into the relative probability of the various values of i that are selected by the process of FIG. 7. On the other hand, if the maximum permitted value of $\Delta W$ is too low it might be possible for a particularly skilled player to anticipate the stopping positions of the reels 12–14. Therefore in the preferred embodiment of the invention, the maximum value of $\Delta W$ should be equal to:

$$\Delta W_{max} = \sum_{i=1}^{p} Wi$$

Also, the use of the residual probability value $W_c$ shown at 78, 84, 86, 94 and 96 of FIG. 7 is desirable since it tends to smooth the operation of the process from one 60 ms interrupt interval to another.

As a practical matter it has been found that the procedure of FIG. 7 using the preferred range of values of $\Delta W$ and with 60 ms interrupts 70 will on the average cycle twice through all the reel stops indexes $i-1$ through p every two seconds. Two seconds represents the average duration between handle pulls for a skilled player. Thus the second embodiment of the invention as described above will provide an essentially random selection of reel stops. Further this embodiment of the invention provides a particularly flexible method for adjusting the relative probability of the reels 12–14 stopping at the various reel stops which is especially useful in implementing the plateaued, non-rounded payouts described above.

We claim:

1. A gaming apparatus having a coin input, a memory, a processor for randomly selecting and displaying a plurality of indicia wherein certain predetermined combinations of the indicia result in corresponding payouts comprising:

detection means operatively associated with the processor for detecting the selected indicia;

pay means operatively associated with said detection means and the processor for generating a pay signal representing one of the payouts according to a first pay schedule contained in said memory wherein said pay schedule is composed of a maximum win corresponding to one of the predetermined combinations of indicia wherein said maximum win is at least 1000 times greater than the value of a coin input, at least four of the predetermined combinations result in payouts that are less than but within 80% of an administrative value, wherein said administrative value is based upon an external administrative requirement, and wherein the remaining predetermined combinations result in payouts less than said administrative value.

2. The apparatus of claim 1 wherein at least six of said predetermined combinations result in payouts less than but within 80% of said administrative value.

3. The apparatus of claim 1 wherein said maximum win is at least 20 times greater than said administrative value.

4. The apparatus of claim wherein said remaining predetermined combinations result in payouts having less than one-half of said administrative value.

5. The apparatus of claim 1 wherein a majority of said predetermined combinations resulting in payouts within 80% of said administrative value result in payouts with non-rounded values.

6. The apparatus of claim 1 wherein said memory additionally includes a second pay schedule wherein said second pay schedule is composed of a maximum win corresponding to said one of said predetermined combinations where said maximum win has a value of less than one-fourth of said maximum win in said first pay schedule and wherein the remaining predetermined combinations result in payouts less than said administrative value; and wherein said pay means responds to the coin input having a first value to select said first pay schedule and to the coin input having a second value which is less than said first value to select said second pay schedule.

7. A gaming apparatus having a plurality of symbol bearing reels mounted for rotation about an axis comprising:

input means for receiving coins from a player;

a processor operatively connected to said input means and the reels for initiating rotation and randomly stopping the reels in a win position in response to at least one coin having a first input value received from a player;

a memory operatively associated with said processor containing a first pay schedule that includes a first maximum payout value having a value at least 10 times greater than an administrative value, wherein said administrative value is based upon an external administrative requirement, said first maximum payout value being associated with a first predetermined combination of the symbols, a first group of at least 4 payout values that are less than but within 80% of said administrative value, said first group of payout values being associated with a first group of predetermined combinations of the symbols and a second group of payout values that are less than said first group of payout values, said second group of payout values being associated with a second group of predetermined combinations of the symbols;

detection means operatively associated with said processor for identifying the symbols located at the win position when the reels have been stopped by said processor; and pay means operatively associated with said detection means and said memory for generating a pay signal according to said first pay schedule in response to the identification of said symbols stopped at the win position.

8. The apparatus of claim 7 wherein said maximum win value is at least 1000 times greater than the value of said coin input.

9. The apparatus of claim 8 wherein said first group of payout values includes at least six of said payout values within 80% of said administrative value.

10. The apparatus of claim 9 wherein a majority of said first group of payout values result in payouts with non-rounded values.

11. The apparatus of claim 9 wherein said administrative value is $1,200 and said first group of payout values are between $1,195 and $1,000.

12. The apparatus of claim 8 wherein said memory includes a second pay schedule having a second maximum payout value having a value at least 1000 times the value of a second coin input value, said second maximum payout value being associated with said first predetermined combination of symbols and a third group of payout values having values less than said administrative value, said third group of payout values being associated with second and third group of predetermined combinations of symbols; and wherein said pay means includes selection means responsive to said input means for selecting said first pay schedule for coin inputs having said first value and said second pay schedule for coin inputs having said second value.

13. The apparatus of claim 12 wherein said first coin input value is greater than said second coin input value.

14. The apparatus of claim 13 wherein said second coin input value is represented by a single coin and said first coin input value is represented by two of said coins.

15. The apparatus of claim 13 wherein all said third group of payout values are equal to or less than one-half of said administrative values.

16. The apparatus of claim 12 wherein said administrative value if $1,200, said first group of payout values are between $1,195 and $1,000, and each payment value in said third group of payout values is equal to or less than $500.

17. The apparatus of claim 16 wherein said first maximum payout value if $25,000, and said second maximum payout value if $5,000.

18. The apparatus of claim 17 wherein said first coin input value is $10.00 and said second coin input value is $5.00.

19. The apparatus of claim 7 wherein said administrative value is $1,200 and said first group of payout values are between $1,195 and $1,000.

20. The apparatus of claim 19 wherein said first maximum value is $25,000.

21. The apparatus of claim 19 wherein each payout value in said second group of payout values is equal to or less than $500.

22. The apparatus of claim 7 wherein each of the reels has a predetermined number of reel stops, said memory includes a stop index and an associated probability factor for each of the reels and wherein said processor includes: means for randomly stopping each of the reels proportionately to said probability factors.

* * * * *

UNITED STATES PATENT AND TRADEMARK OFFICE

CERTIFICATE OF CORRECTION

PATENT NO. : 4,991,848

DATED : February 12, 1991

INVENTOR(S) : Nick E. Greenwood and Dominic Tiberio

It is certified that error appears in the above-identified patent and that said Letters Patent is hereby corrected as shown below:

Column 6, Claim 4, line 1 after "claim" insert -- 1 --

Signed and Sealed this

Nineteenth Day of May, 1992

*Attest:*

DOUGLAS B. COMER

*Attesting Officer*

*Acting Commissioner of Patents and Trademarks*